US011731425B2

(12) United States Patent
Komamiya

(10) Patent No.: US 11,731,425 B2
(45) Date of Patent: Aug. 22, 2023

(54) LIQUID DISCHARGE HEAD

(71) Applicant: CANON KABUSHIKI KAISHA, Tokyo (JP)

(72) Inventor: Yumi Komamiya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 17/476,045

(22) Filed: Sep. 15, 2021

(65) Prior Publication Data

US 2022/0080731 A1 Mar. 17, 2022

(30) Foreign Application Priority Data

Sep. 17, 2020 (JP) ..... 2020-156221

(51) Int. Cl.
*B41J 2/14* (2006.01)
*B41J 2/155* (2006.01)

(52) U.S. Cl.
CPC ..... *B41J 2/14145* (2013.01); *B41J 2/155* (2013.01)

(58) Field of Classification Search
CPC ..... B41J 2/14145; B41J 2/155
See application file for complete search history.

(56) References Cited

U.S. PATENT DOCUMENTS

2020/0307199 A1* 10/2020 Koide ..... B41J 2/175

FOREIGN PATENT DOCUMENTS

JP 2017213871 A 12/2017

* cited by examiner

*Primary Examiner* — Jason S Uhlenhake
(74) *Attorney, Agent, or Firm* — Canon U.S.A., Inc. I.P. Division

(57) ABSTRACT

A liquid discharge head includes an element substrate including a plurality of discharge ports configured to discharge liquid in a discharge direction onto a recording medium, and a heating element configured to heat the liquid, and a flow path member including a supply flow path configured to supply the liquid to the element substrate and a collection flow path configured to collect the liquid from the element substrate. The supply flow path and the collection flow path extend in a longitudinal direction of the flow path member and at least a part of the supply flow path and at least a part of the collection flow path overlap each other when being viewed in the direction parallel to the discharge direction.

10 Claims, 10 Drawing Sheets

RECORDING MEDIUM CONVEYANCE DIRECTION
DIRECTION AS VIEWED FROM DISCHARGE PORT OPENING SIDE
LIQUID DISCHARGE DIRECTION 60
211(212)
212(211)
211
212
B
B'

LIQUID DISCHARGE HEAD

BACKGROUND

Field of the Disclosure

The present disclosure relates to liquid discharge heads.

Description of the Related Art

Examples of a liquid discharge apparatus that discharges liquid onto a recording medium, such as paper, include an ink-jet printer. The ink-jet printer includes a liquid discharge head, which is a portion that discharges the liquid. The liquid discharge head is equipped with discharge ports for discharging the liquid, pressure generation elements that generate pressure for discharging the liquid from the discharge ports, a pressure chamber on which the pressure generated by the pressure generation element is exerted, and the like.

The viscosity of the liquid desirably falls within a desired range during an operation of discharging the liquid from the discharge ports, and the discharge performance may decrease if the viscosity of the liquid falls outside the desired range. Japanese Patent Application Laid-Open No. 2017-213871 discusses a liquid discharge head in which a heating element that controls the viscosity of the liquid by heating the liquid is provided near the pressure chamber. This method is intended to adjust the temperature of the liquid to control the viscosity thereof by driving the heating element to heat the liquid only to a degree of not causing bubbling. Further, the liquid discharge head discussed in Japanese Patent Application Laid-Open No. 2017-213871 includes a collection flow path for collecting the liquid from the pressure chamber and has a flow path configuration capable of circulating the liquid in the flow path on the upstream side and the downstream side of the pressure chamber in order to prevent an increase in the viscosity of the liquid resulting from evaporation of the liquid from the discharge ports.

In the case where the heating element for controlling the viscosity of the liquid is provided near the pressure chamber as discussed in Japanese Patent Application Laid-Open No. 2017-213871, the liquid warmed by the heating element is supposed to flow into the collection flow path, which is on the downstream side of the pressure chamber. Thus, the liquid flowing in the collection flow path has a higher temperature than the temperature of the liquid flowing in a supply flow path for supplying the liquid to the pressure chamber, which is on the upstream side of the pressure chamber. As a result, a flow path member including the collection flow path and the supply flow path has a higher temperature around the collection flow path than the temperature around the supply flow path, so that unevenness in the temperature (a temperature gradient) occurs in the flow path member. Such a temperature gradient also occurs in a case where heating elements for causing film boiling in the liquid is provided to the pressure chamber as the pressure generation elements even without the heating elements for controlling the viscosity of the liquid. Thus, with the collection flow path and the supply flow path arranged side by side in a conveyance direction of the recording medium, the flow path member may be deformed to protrude in the conveyance direction of the recording medium due to the temperature gradient in the flow path member, ending up affecting the recording quality.

SUMMARY OF THE DISCLOSURE

In view of the above-described issues, the present disclosure includes embodiments providing a liquid discharge head capable of controlling deformation of a flow path member to protrude in a conveyance direction of a recording medium.

According to an aspect of the present disclosure, a liquid discharge head includes an element substrate including a plurality of discharge ports configured to discharge liquid in a discharge direction onto a recording medium, and a heating element configured to heat the liquid, and a flow path member including a supply flow path configured to supply the liquid to the element substrate and a collection flow path configured to collect the liquid from the element substrate. The supply flow path and the collection flow path extend in a longitudinal direction of the flow path member and at least a part of the supply flow path and at least a part of the collection flow path overlap each other when viewed in a direction parallel to the discharge direction from one side to which the discharge ports are opened.

Further features of the present disclosure will become apparent from the following description of exemplary embodiments with reference to the attached drawings.

DESCRIPTION OF THE EMBODIMENTS

In the following description, examples of embodiments of the present disclosure will be described with reference to the drawings. A deformation of a flow path member tends to increase as the length of the flow path member increases. Thus, the present disclosure is effectively applicable in particular to a page wide-type head that includes a longer flow path member than a flow path member of a serial-type liquid discharge head and corresponds to the recording width of a recording medium, such as paper. The page wide-type head refers to a head including a plurality of discharge ports arrayed from a portion corresponding to one end of a recording medium to a portion corresponding to the other end of a recording medium in a direction intersecting a conveyance direction of the recording medium. In the following description, the page wide-type head will be described as an example.

(Recording Apparatus)

Figure 1:
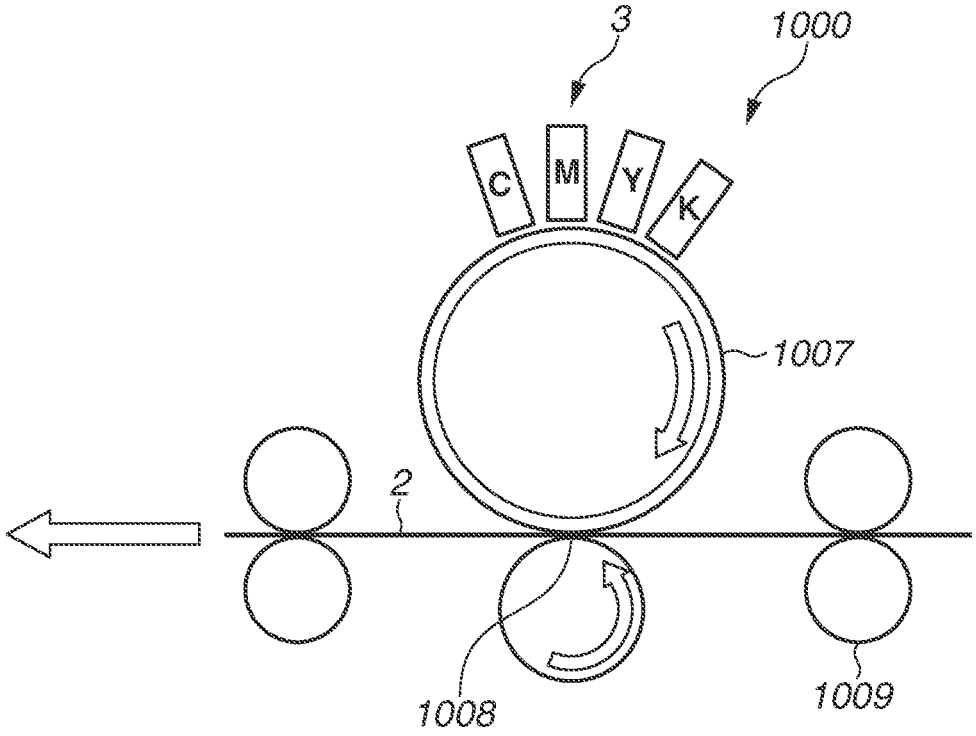
FIG. 1 is a schematic view of a recording apparatus.

A recording apparatus will be described with reference to FIG. 1. FIG. 1 is a schematic view illustrating an example of a recording apparatus 1000 with a liquid discharge head 3 mounted thereon. The recording apparatus 1000 illustrated in FIG. 1 discharges liquid from the liquid discharge head 3 onto an intermediate transfer member (an intermediate transfer drum) 1007 to form an image pattern (a printing pattern) on the intermediate transfer member 1007, and transfers this image pattern onto a recording medium 2 after that. In the recording apparatus 1000, at least four single-color liquid discharge heads 3 each corresponding to a different one of four types of ink, cyan, magenta, yellow, and black (CMYK), are arranged in a circular arc manner along the intermediate transfer member 1007. With this arrangement, the image pattern is recorded onto the intermediate transfer member 1007 in full color, and this recording image pattern is appropriately dried on the intermediate transfer member 1007. After that, the recording image pattern is transferred from the top surface of the intermediate transfer member 1007 to the recording medium 2 by a transfer roller 1008. At this time, the recording image pattern is transferred while the recording medium 2 is being conveyed by a paper conveyance roller 1009.

While FIG. 1 illustrates the recording apparatus 1000 that carries out recording using the intermediate transfer member 1007, the recording apparatus including the liquid discharge head according to the present disclosure is not limited thereto. More specifically, a recording apparatus that carries out recording by directly discharging the liquid from the liquid discharge head 3 onto the recording medium 2 without using the intermediate transfer member 1007 may be used.

(Route of Liquid)

Figure 2:
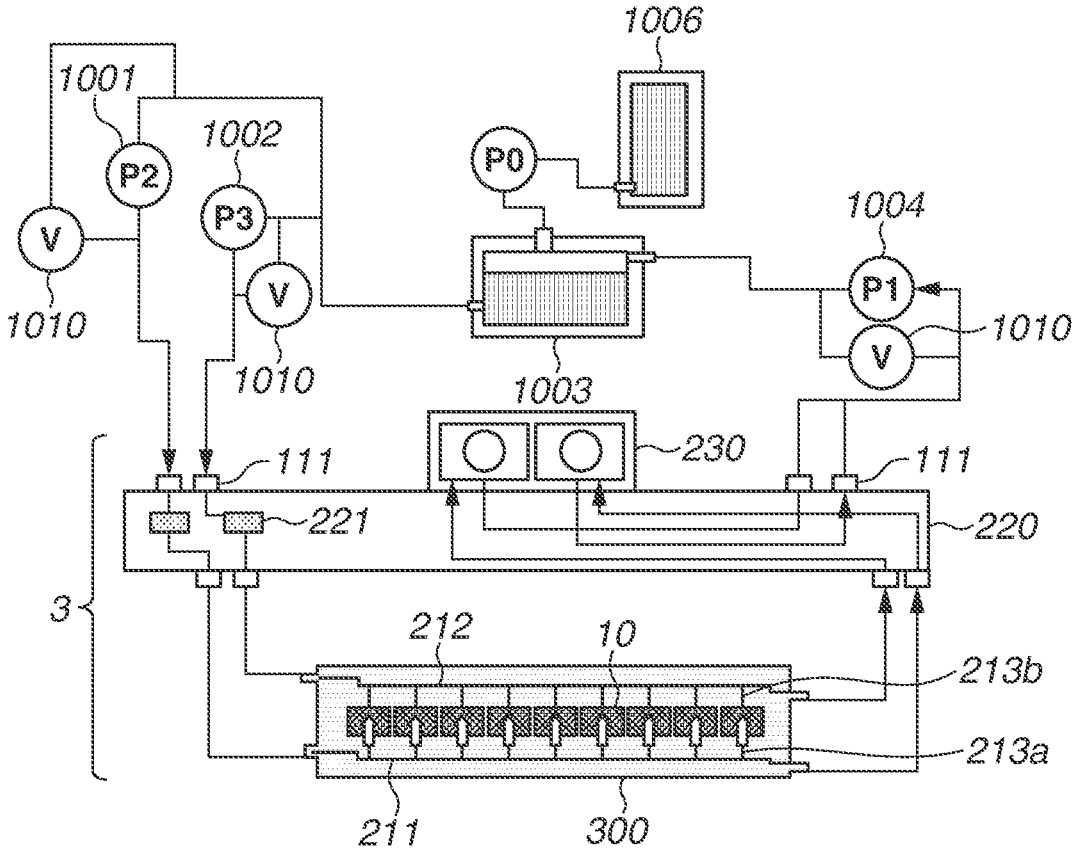
FIG. 2 is a schematic view illustrating a flow route of liquid in the recording apparatus.

The route of the liquid will be described with reference to FIG. 2. FIG. 2 is a schematic view illustrating the flow route of the liquid in the recording apparatus 1000. Two pressure adjustment mechanisms that form negative pressure control units 230 control the pressure so as to keep a pressure change on the upstream side of the negative pressure control units 230 within a predetermined range around a desired setting pressure (such mechanisms correspond to mechanism components functioning in a similar manner to a "backpressure regulator"). Thus, the negative pressure control units 230 function to stabilize the pressure change on the upstream side (a liquid discharge unit 300 side) of the negative pressure control units 230 within the predetermined range around the preset pressure even if the flow amount of the liquid changes due to a change in a recording duty in carrying out the recording using the liquid discharge head 3. A second circulation pump 1004 functions as a negative pressure source that depressurizes the flow path (liquid in the flow path) on the downstream side of the negative pressure control units 230. A first circulation pump (high-pressure side) 1001 and a first circulation pump (low-pressure side) 1002 are disposed on the upstream side of the liquid discharge head 3, and the negative pressure control units 230 is disposed in the liquid discharge head 3.

Desirably, the flow path (liquid in the flow path) on the downstream side of the negative pressure control units 230 is pressurized by the second circulation pump 1004 via liquid supply units 220. Such an arrangement enables control of the influence of a water head pressure of a buffer tank 1003 on the liquid discharge head 3, thus expanding a range of selection for the layout of the buffer tank 1003 in the recording apparatus 1000. For example, instead of the second circulation pump 1004, a water head tank disposed with a predetermined water head difference from the negative pressure control units 230 is also applicable.

The negative pressure control units 230 include the two pressure adjustment mechanisms for each of which a different control pressure is set. The high-pressure setting side (labeled H in FIG. 4B) and the low-pressure side (labeled L in FIG. 4B) of the two negative pressure adjustment mechanisms are each connected to a common supply flow path 211 and a common collection flow path 212 in the liquid discharge unit 300 via the inside of the liquid supply units 220. The two negative pressure adjustment mechanisms adjust the pressure in the common supply flow path 211 to a higher pressure than the pressure in the common collection flow path 212, thus generating an ink flow that flows from the common supply flow path 211 to the common collection flow path 212 via an individual supply flow path 213*a* and an inner flow path of each element substrate 10 (such an ink flow is indicated by arrows in FIG. 4B).

The negative pressure control units 230 are disposed on the downstream side of the liquid discharge head 3, thus reducing a risk that dust and a foreign object generated from the negative pressure control units 230 flow into the head. Such an arrangement reduces also a maximum value of a required flow amount supplied from the buffer tank 1003 to the liquid discharge head 3. The reason therefor is as follows. Suppose that A represents the sum of the flow amounts in the common supply flow path 211 and the common collection flow path 212 when the liquid is circulated while the recording apparatus 1000 is on standby for recording. The value of A is defined to be a minimum flow amount required to keep the temperature difference in the liquid discharge unit 300 within a desired range when the temperature in the liquid discharge head 3 is adjusted while the recording apparatus 1000 is on standby for recording. Further, F is defined as a discharge flow amount when the ink is discharged from all the discharge ports (not illustrated) of the liquid discharge unit 300 (such a case is also referred to as "when all the ports are discharging"). In this case, the amount of the liquid supplied to the liquid discharge head 3 when the recording apparatus 1000 is on standby for recording is the flow amount A. The amount of the supply to the liquid discharge head 3 required when the ink is discharged from all the ports is the flow amount F. This means that the sum of the setting flow amounts of the first circulation pump (the high-pressure side) 1001 and the first circulation pump (the low-pressure side) 1002, i.e., the maximum value of the required supply flow amount is the value of larger one of A and F. Thus, the maximum value of the required supply amount (A or F) decreases as long as the liquid discharge unit 300 having the same configuration is used. This leads to an increase in the flexibility of an employable circulation pump, thus producing an advantageous effect of, for example, allowing the use of a simply-configured low-cost circulation pump and reducing the load on a cooler (not illustrated) provided in the route on the main body side, resulting in a reduction in the cost of the main body of the recording apparatus 1000. This advantageous effect increases for a line head in which the value of A or F relatively increases, and becomes more beneficial for a line head having a longer longitudinal length among line heads.

For example, in a case where a failure has occurred in the function of the first circulation pump 1001 or 1002, an excessive flow amount or pressure may be applied to the liquid discharge head 3. This may result in a leak of the liquid from a discharge port of the liquid discharge head 3 or a fracture at any of joint portions in the liquid discharge head 3. However, in a case where bypass valves are added to the first circulation pumps 1001 and 1002, such troubles can be avoided because the liquid route is opened to the upstream side of each circulation pump by the bypass valve 1010 being opened, even when an excessive pressure occurs.

When the circulation driving is stopped, all the bypass valves 1010 are quickly opened based on a control signal from the main body after the first circulation pumps 1001 and 1002 and the second circulation pump 1004 are stopped. As a result, the high negative pressure (e.g., several kPa to several dozen kPa) in a downstream section of the liquid discharge head 3 (i.e., between the negative pressure control units 230 to the second circulation pump 1004) can be released in a short time. In a case where a displacement pump, such as a diaphragm pump, is used as the circulation pump, normally, a check valve is built in the pump. However, the pressure in the downstream section of the liquid discharge head 3 can also be released from the buffer tank 1003 side on the downstream side by opening the bypass valve 1010. The pressure in the downstream section of the liquid discharge head 3 can be released even from the upstream side alone, but a pressure loss occurs in the flow path on the upstream side of the liquid discharge head 3 and the flow path in the liquid discharge head 3. Therefore, the pressure release may take a long time, and the pressure in the common flow path in the liquid discharge head 3 may transitionally excessively reduce and the meniscus at the discharge ports may be broken. Opening the bypass valve 1010 on the downstream side of the liquid discharge head 3 facilitates the pressure release on the downstream side of the liquid discharge head 3, thus reducing the risk of breaking the meniscus at the discharge ports.

FIG. 2 illustrates the recording apparatus 1000 that is configured to circulate the liquid, such as the ink, between a main tank 1006 and the liquid discharge head 3, but the present disclosure is not limited thereto. For example, the recording apparatus may be configured to include a tank on each of the upstream side and the downstream side of the liquid discharge head and cause the ink to flow by transmitting the ink from one of the tanks to the other without circulating the ink.

(Liquid Discharge Head)

Figure 3A:
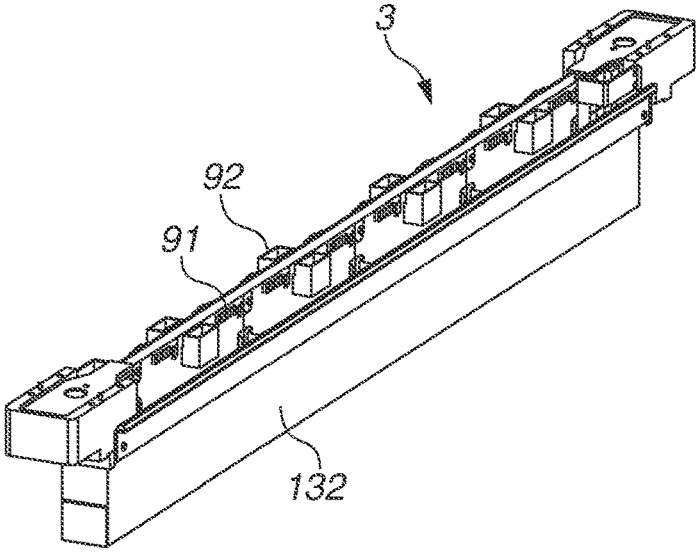
FIGS. 3A and 3B are perspective views of a liquid discharge head.
Figure 3B:
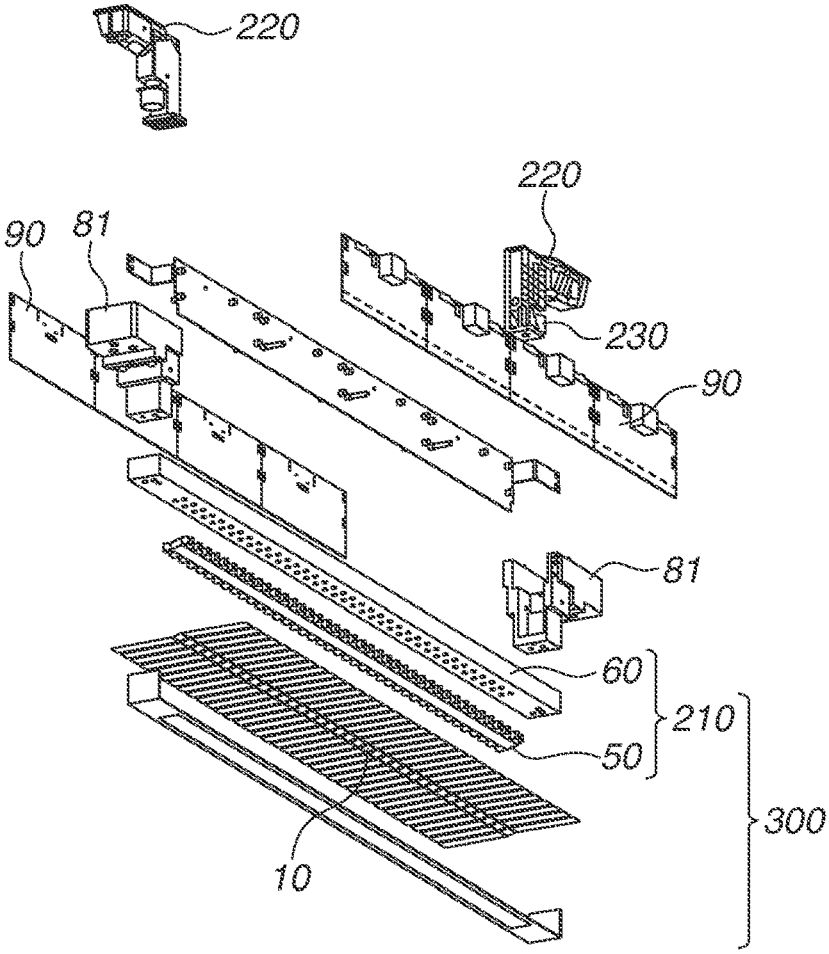
Figure 4A:
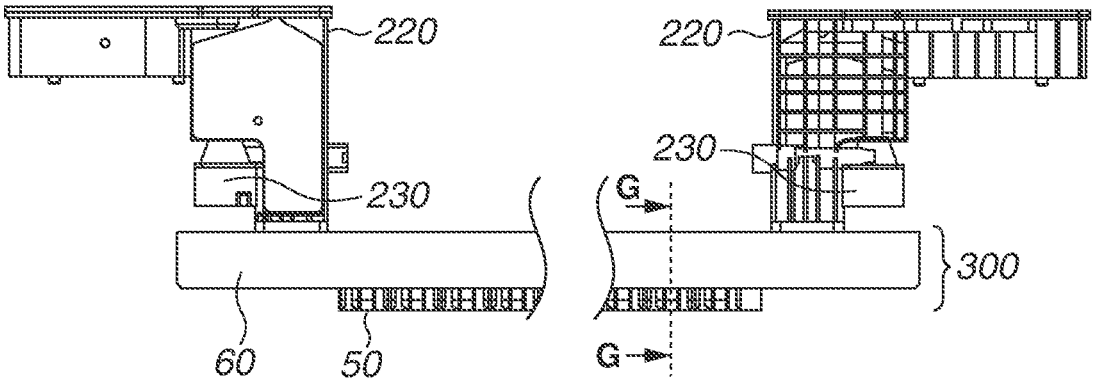
FIGS. 4A and 4B are side views of the liquid discharge head.
Figure 4B:
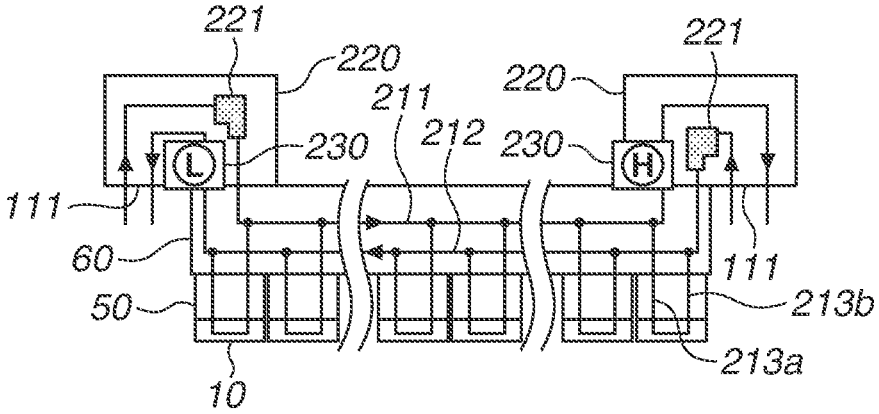

The liquid discharge head 3 will be described with reference to FIGS. 3 to 5. FIG. 3A is a perspective view of the liquid discharge head 3. FIG. 3B is an exploded perspective view of the liquid discharge head 3 (a shield plate 132 is not illustrated). FIG. 4A is a side view of the liquid discharge head 3. FIG. 4B is a schematic view illustrating the flow of the liquid inside the liquid discharge head 3. The flow of the circulation of the liquid illustrated in FIG. 4B is the same as the route of the circulation illustrated in FIG. 2 in terms of the circuit, but FIG. 4B illustrates the flow of the liquid in each component of the actual liquid discharge head 3. The illustrated configuration is partially simplified to facilitate the understanding.

The liquid discharge head 3 includes element substrates 10, which discharge the liquid from discharge ports 13, and a flow path member 210, which has flow paths for supplying and collecting the liquid to and from the element substrates 10. The liquid discharge head 3 is a page wide-type head including 36 element substrates 10 arrayed linearly (in line) in the longitudinal direction of the liquid discharge head 3. Pressure generation elements 5 (FIGS. 5A and 5B) and heating elements 15 are formed on the respective element substrate 10. The pressure generation elements 5 generate the pressure for discharging the liquid from the discharge ports 13. The heating elements 15 heat the liquid to adjust the temperature of the liquid in a pressure chamber 7. The liquid in the pressure chamber 7 is heated by the heating elements 15, and the liquid is adjusted to viscosity suitable for the discharge. The liquid discharge head 3 includes a signal input terminal 91 for receiving a signal and a power supply terminal 92 for receiving power from outside the liquid discharge head 3, the shield plate 132 for protecting the side surface of the liquid discharge head 3, and the like.

The liquid discharge head 3 ensures the rigidity of the liquid discharge head 3 by a second flow path member 60 forming the flow path member 210. Liquid discharge unit support units 81 are connected to both ends of the second flow path member 60, and this liquid discharge unit 300 positions the liquid discharge head 3 by being mechanically coupled with a carriage of the recording apparatus 1000. The liquid supply units 220 including the negative pressure control units 230, and an electric wiring board 90 are coupled with the liquid discharge unit support units 81. A filter (not illustrated) is built in each of the two liquid supply units 220. The two negative pressure control units 230 are each set so as to control the pressure with relatively high and low negative pressures different from each other.

Next, details of the flow path member 210 of the liquid discharge unit 300 will be described. The flow path member 210 is formed by stacking a first flow path member 50 and the second flow path member 60, and distributes the liquid supplied from the liquid supply units 220 to each of discharge modules 200. Further, the flow path member 210 functions as a flow path member for returning the liquid flowing back from respective element substrates 10 to the liquid supply units 220. The second flow path member 60 of the flow path member 210 serves as a flow path member including the common supply flow path 211 and the common collection flow path 212 formed therein, and also has a function of playing a main role in maintaining the rigidity of the liquid discharge head 3. Thus, desirably, the second flow path member 60 is made from a material sufficiently corrosive-resistant against the liquid and highly mechanically strong. More specifically, stainless steel (steel use stainless (SUS)), titanium (Ti), alumina, or the like can be desirably used.

The first flow path member 50 is formed by arraying a plurality of members corresponding to the respective element substrates 10 adjacent to each other. This configuration enables the plurality of element substrates 10 to be disposed on the first flow path member 50, thus enabling the length of the liquid discharge head 3 to correspond to the width of the recording medium 2. This can be applied especially effectively to, for example, a relatively long scale liquid discharge head corresponding to the B2 size or a longer size. The individual supply flow path 213*a* and the individual collection flow path 213*b* of the first flow path member 50 are in fluid communication with the element substrates 10.

A flow path in communication with respective discharge ports 13 is formed on the respective element substrates 10, allowing the supplied liquid to partially or entirely flow back by passing through the discharge ports 13 that stop the discharge operation. The common supply flow path 211 is connected to the negative pressure control unit 230 (the high-pressure side) and the common collection flow path 212 is connected to the negative pressure control unit 230 (the low-pressure side), via the liquid supply units 220. Thus, the differential pressure therebetween causes the ink to flow from the common supply flow path 211 to the common collection flow path 212 by passing through the discharge ports 13 of the respective element substrates 10.

The pair of common supply flow path 212 and common collection flow path 212 extending in the longitudinal direction of the liquid discharge head 3 is provided in the second flow path member 60 having a long length. The flow direction of the liquid flowing in the common supply flow path 211 is opposite to the flow direction of the liquid flowing in the common collection flow path 212, and a filter 221 is provided on the upstream side of each of the flow paths and catches a foreign object entering from a liquid connection portion 111 or the like. It is desirable to cause the liquid to flow in the common supply flow path 211 and the common collection flow path 212 in the opposite directions in this manner because this facilitates a thermal exchange between the common supply flow path 211 and the common collection flow path 212, thus reducing a temperature gradient in the longitudinal direction in the liquid discharge head 3. Note that FIG. 2 illustrates the flows in the common supply flow path 211 and the common collection flow path 212 in the same direction for simplification of the description.

The respective negative pressure control units 230 are connected to the corresponding one of the downstream sides of the common supply flow path 211 and the common collection flow path 212. Branch portions leading to the plurality of individual supply flow paths 213*a* are included along the common supply flow path 211, and branch portions leading to the plurality of individual collection flow paths 213*b* are included along the common collection flow path 212. The individual supply flow paths 213*a* and the individual collection flow paths 213*b* are formed in the plurality of first flow path members 50.

The negative pressure control units 230 labeled H and L in FIG. 4B are the units on the high-pressure side (H) and the low-pressure side (L). Each of the negative pressure control units 230 is a backpressure-type pressure adjustment mechanism set so as to control the pressure on the upstream side of the negative pressure control units 230 with the relatively high (H) or low (L) negative pressure. The common supply flow path 211 is connected to the negative pressure control unit 230 (H) and the common collection flow path 212 is connected to the negative pressure control unit 230 (L), by which the differential pressure is generated between the common supply flow path 211 and the common collection flow path 212. Due to this differential pressure, the liquid flows from the common supply flow path 211 into the common collection flow path 212 by passing through the individual supply flow path 213*a*, the respective element substrates 10, and the individual collection flow path 213*b* sequentially. The liquid in the respective element substrates 10 flows as indicated by arrows illustrated in FIG. 4B.

Figure 5A:
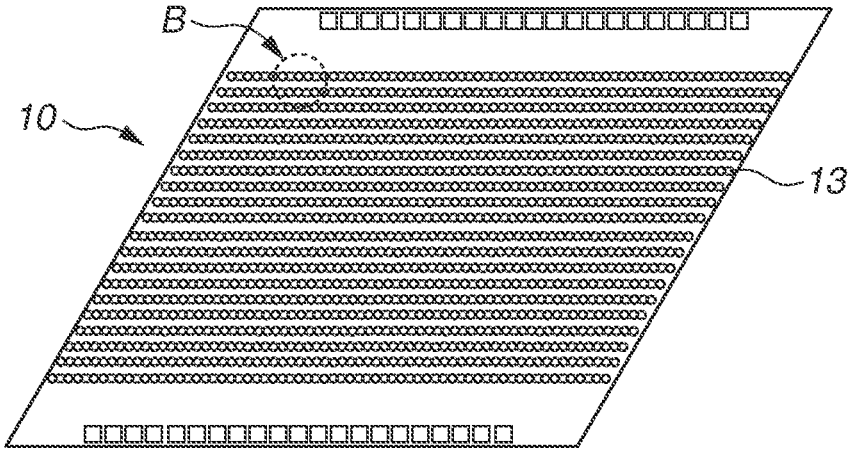
FIGS. 5A and 5B are top views of an element substrate.
Figure 5B:
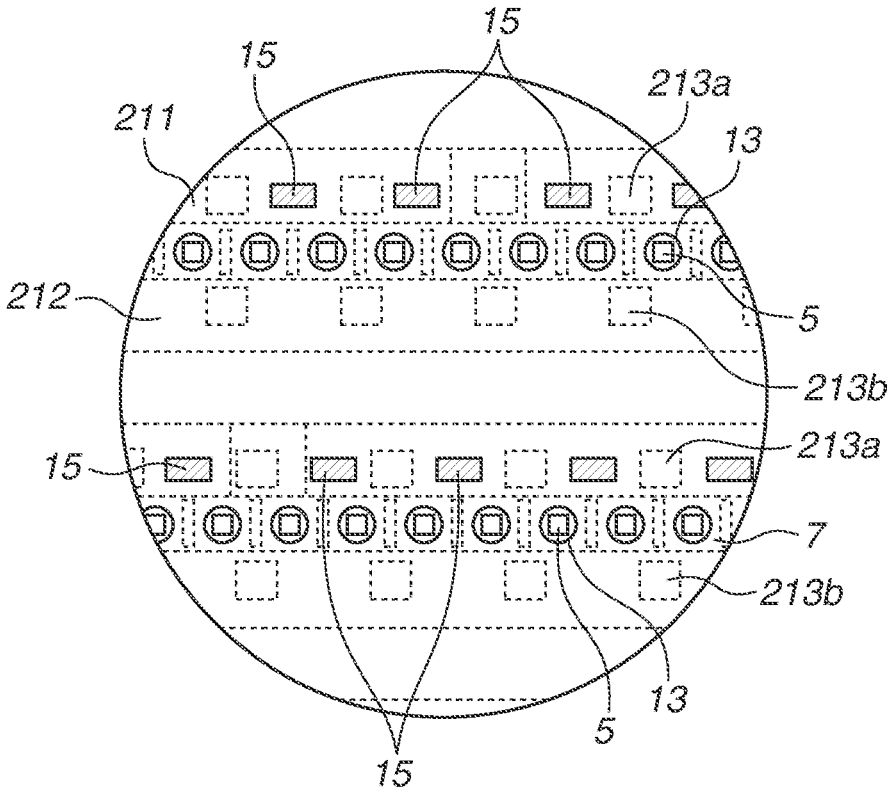

FIG. 5A is a top view of the element substrate 10. FIG. 5B is an enlarged view of a B portion illustrated in FIG. 5A. The liquid passes through the individual supply flow path 213*a*, and is supplied to the discharge ports 13. Heating elements serving as the pressure generation elements 5 (hereinafter referred to as the main heaters 5) are formed immediately below the discharge ports 13. The main heaters 5 are driven to bring about film boiling in the liquid, thus acquiring the pressure for discharging the liquid from the discharge ports 13. The heating elements 15 for heating the liquid to control the viscosity of the liquid (such heating elements are hereinafter referred to as sub heaters) are each formed near the respective discharge ports 13 along the direction in which the discharge ports 13 are arrayed. The liquid is heated and the viscosity of the liquid can be controlled by driving the sub heaters 15.

First Exemplary Embodiment

Figure 6A:
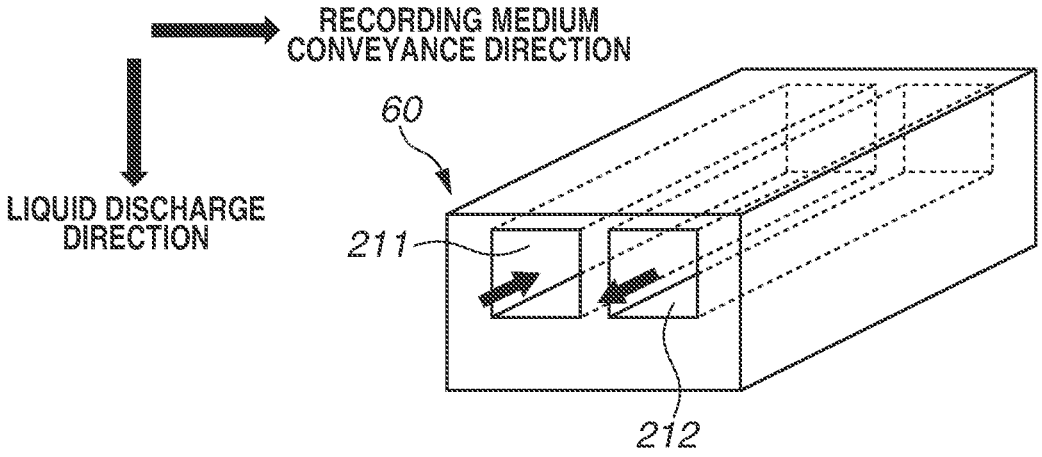
FIGS. 6A and 6B are schematic views illustrating the internal structure of a flow path member according to a comparison example.
Figure 6B:
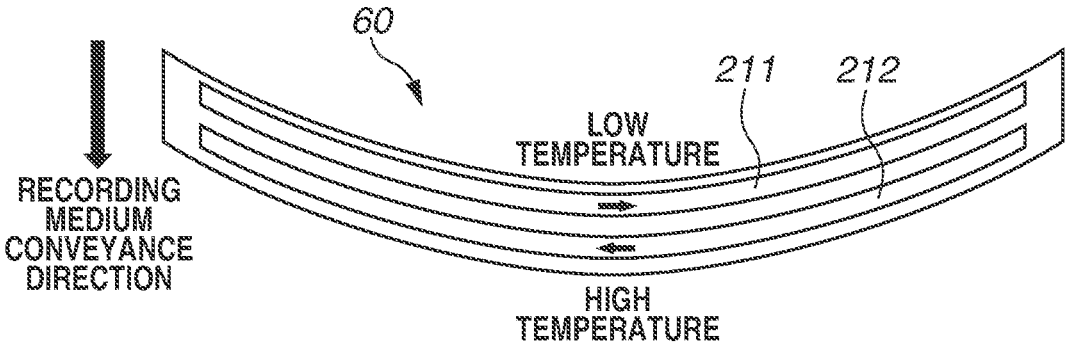
Figures 7A, 7B, 7C, 7D, 7E, 7F, 7G, 7H, 7I, 7J, 7K, 7L, 7M, 7N:
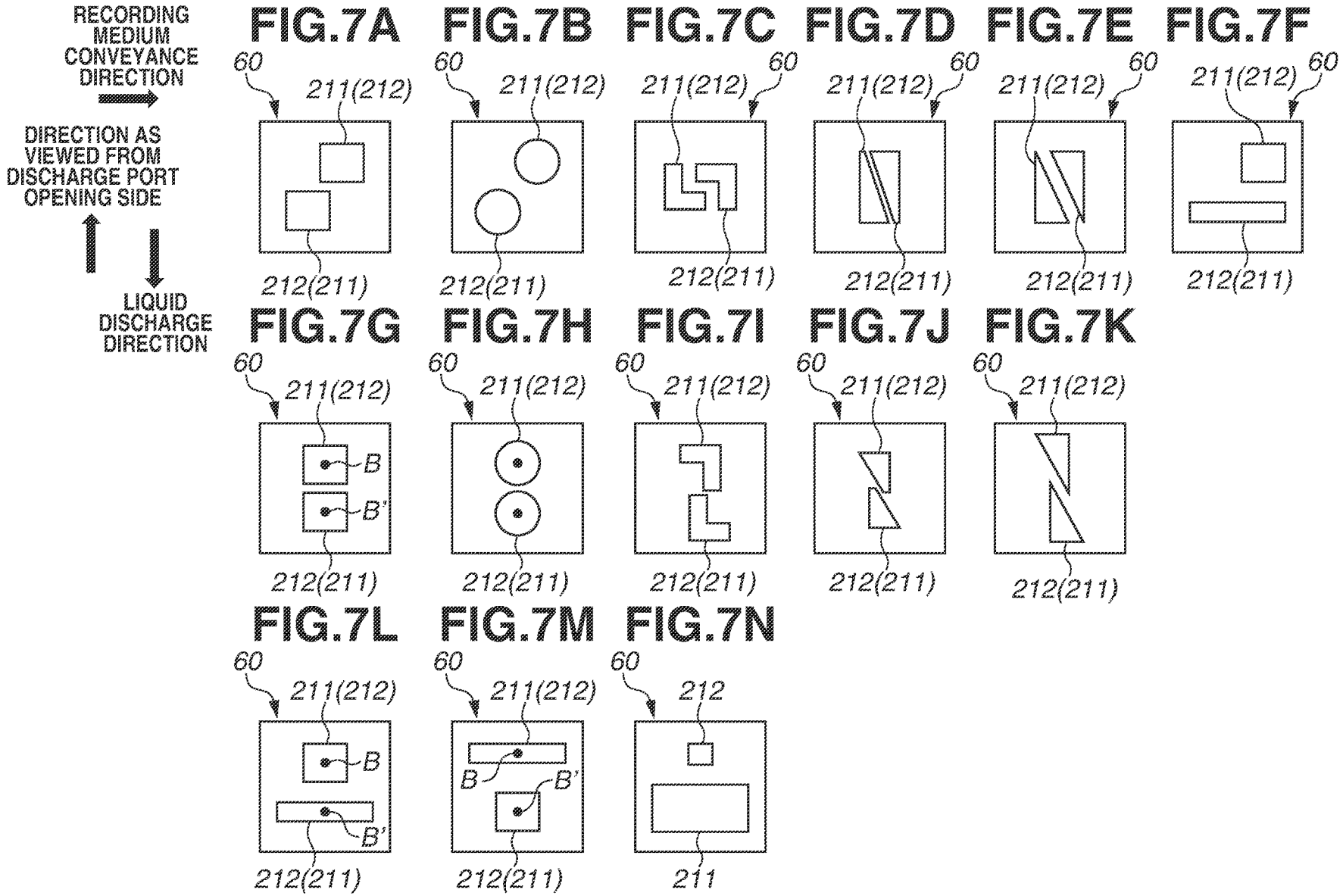
FIGS. 7A to 7N are schematic views each illustrating a cross section of a second flow path member.
Figure 8:
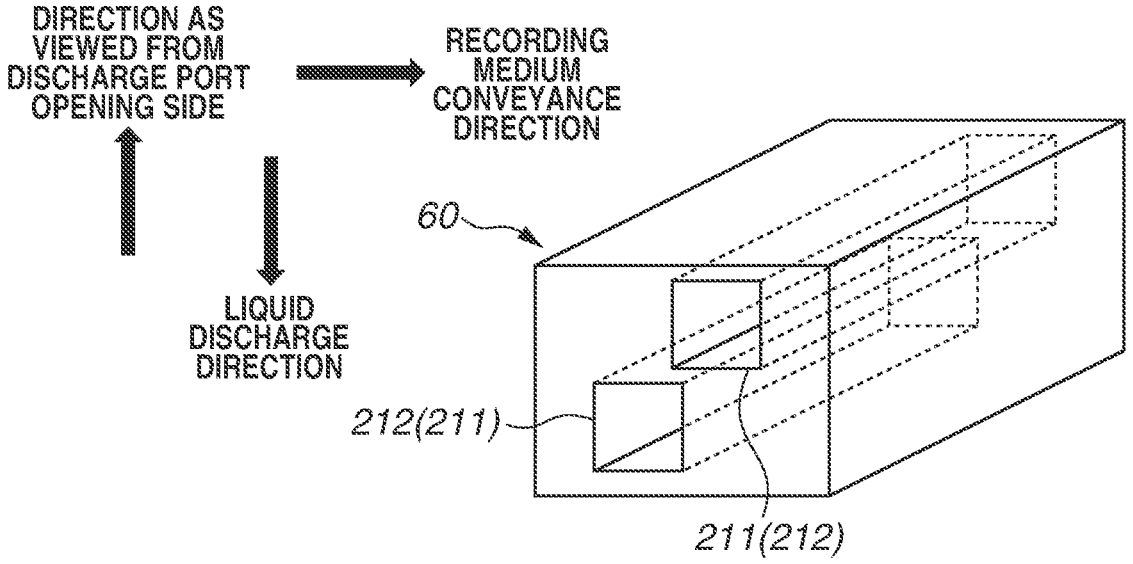
FIG. 8 is a perspective view of the second flow path member illustrated in FIG. 7A.
Figures 9A, 9B, 9C, 9D, 9E:
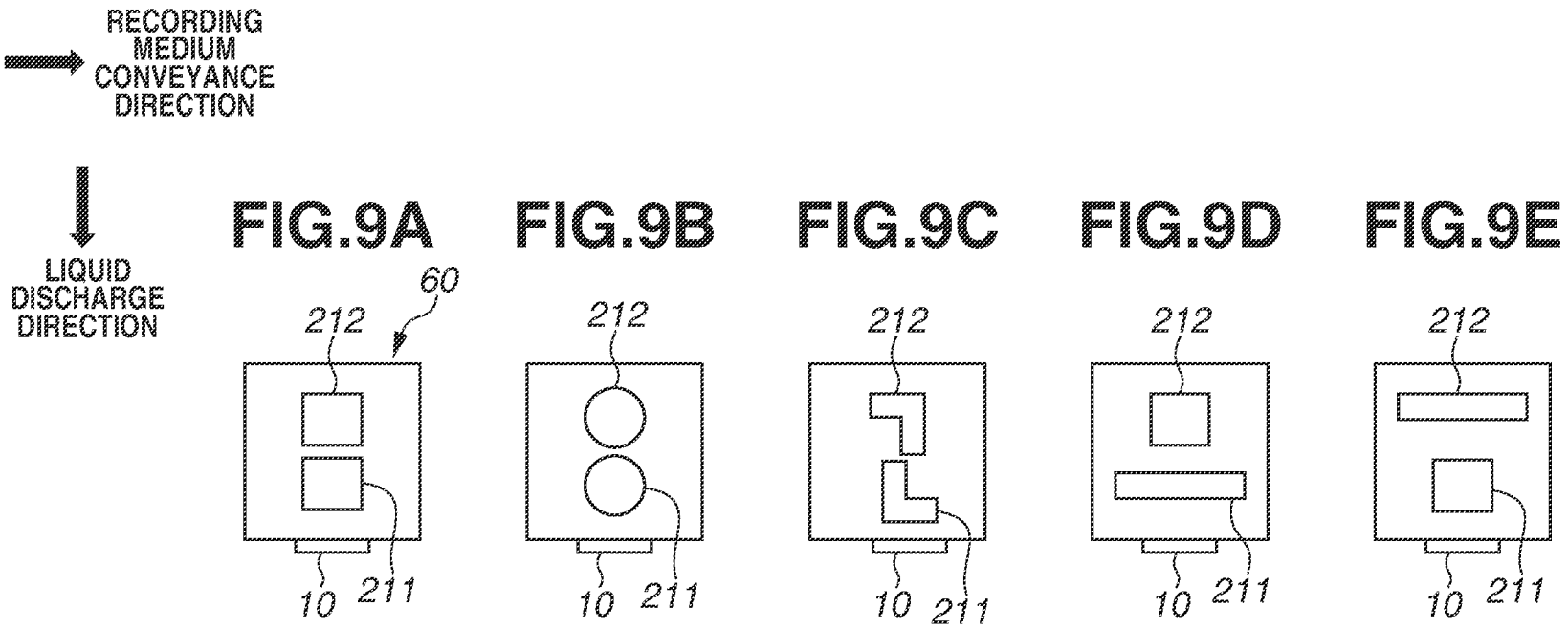
FIGS. 9A to 9E are schematic views of a second flow path member according to a second exemplary embodiment.

A first exemplary embodiment of the present disclosure will be described with reference to FIGS. 6 to 8. FIG. 6A is a schematic view illustrating the internal structure of a flow path member according to a comparison example of the present exemplary embodiment, and is a cross-sectional view taken along a line G-G in FIG. 4A. FIG. 6B is a top view when the second flow path member 60 illustrated in FIG. 6A is viewed from the direction in which the liquid is discharged, and illustrates the internal structure so as to make the inside of the flow paths observable. FIGS. 7A to 7N are schematic views each illustrating the section of the second flow path member 60 according to the present exemplary embodiment. FIG. 8 is a perspective view of the second flow path member 60 illustrated in FIG. 7A. The illustration in FIGS. 6 to 8 are simplified for the description.

As described above, in the liquid discharge head 3 according to the present exemplary embodiment, the common supply flow path 211 and the common collection flow path 212 extend throughout the second flow path member 60 in the longitudinal direction. In other words, the common supply flow path 211 and the common collection flow path 212 are formed along the longitudinal direction of the flow path member 60. The liquid heated to a predetermined temperature by the heating elements flows into the common collection flow path 212 through the individual collection flow path 213*b*. As a result, the temperature of the liquid in the common collection flow path 212 exceeds the temperature of the liquid in the common supply flow path 211, and the second flow path member 60 has a relatively high temperature on the common collection flow path side and a relatively low temperature on the common supply flow path side. Due to this temperature gradient, as illustrated in FIG. 6B, the common collection flow path 212 side is considerably thermally expanded compared to the common supply flow path 211 side, and thus, the second flow path member 60 is warped to protrude toward the common collection flow path 212 side in the recording medium conveyance direction. At this time, as the heated temperature of the liquid increases, or the flow amount of the liquid flowing into the common collection flow path 212 increases, the temperature in the common collection flow path 212 increases, so that the warp amount increases. The degree of warp increases as the length of the second flow path member 60 increases, so that the degree of the warp may further noticeably emerge in the page wide-type liquid discharge head having the length corresponding to the width of the recording medium 2.

In view of this, in the present disclosure, the flow paths are configured as illustrated in FIGS. 7A to 7N to control the warp of the second flow path member 60 in the conveyance direction of the recording medium 2. More specifically, the common supply flow path 211 and the common collection flow path 212 are arranged in such a manner that at least a part of the common supply flow path 211 and at least a part of the common collection flow path 212 overlap each other when viewed from the one side to which the discharge ports 13 are opened in a direction parallel to the discharge direction. Such an arrangement controls the warp of the second flow path member 60 in the recording medium conveyance direction. The phrase "when viewed from the one side to which the discharge ports 13 are opened in a direction parallel to the discharge direction" means when the structure inside the head 3, such as the common supply flow path 211 and the common collection flow path 212 of the second flow path member 60, is transparently viewed. When the common supply flow path 211 and the common collection flow path 212 are arranged in such a manner that at least a part of the common supply flow path 211 and at least a part of the common collection flow path 212 overlap each other, the above-described temperature gradient occurs in a direction intersecting the recording medium conveyance direction. As a result, the occurrence of temperature gradient in the recording medium conveyance direction is prevented, so that the warp of the second flow path member 60 in the recording medium conveyance direction is prevented.

More desirably, as illustrated in FIGS. 7G, 7H, 7L, and 7M, the flow path 211 and the flow path 212 are arranged in such a manner that the position of a center of gravity B of the cross section of the common supply flow path 211 and the position of a center of gravity B' of the cross section of the common collection flow path 212 coincide with each other when viewed from the one side to which the discharge ports 13 are opened in a direction parallel to the discharge direction. This arrangement can significantly reduce the temperature distribution in the recording medium conveyance direction, so that the deformation of the second flow path member 60 in the recording medium conveyance direction can be further controlled. The center of gravity of the cross section refers to the position of the center of gravity of the flow path in the recording medium conveyance direction in each of the cross sections illustrated in FIGS. 7A to 7N. That is, the coincidence of the centers of gravity means that the position of the center of gravity of one of the flow paths in the recording medium conveyance direction coincides with the position of the center of gravity of the other of the flow paths in the recording medium conveyance direction. The coincidence of the positions of the centers of gravity does not necessary mean only a strict (perfect) coincidence but means a coincidence also including an error just within an allowable range in light of the product performance or an error just within a range of error that can occur when product is manufactured. The only requirement for satisfying of the coincidence of the positions is to have the coincidence of the positions of the centers of gravity in at least one cross section, but it is further desirable that the average values of centers of gravity are equal to each other in cross sections at randomly selected 10 locations because this means that the temperature distribution also becomes closer to the evenness as the whole flow path. It is further desirable that the common supply flow path 211 and the common collection flow path 212 entirely overlap each other when viewed from the one side to which the discharge ports 13 are opened in a direction parallel to the discharge direction, as illustrated in FIGS. 7G and 7H. Such a configuration enables further control in the temperature distribution in the recording medium conveyance direction, thus enabling further control of the warp of the second flow path member 60.

Employing the configuration according to the present exemplary embodiment leads to the occurrence of a temperature gradient in the discharge direction of the liquid in the second flow path member 60. As a result, the second flow path member 60 may be warped in the liquid discharge direction. However, when the second flow path member 60 is warped in the liquid discharge direction, a variation occurs in the distance to paper depending on the discharge ports 13 but the position of the discharge ports 13 in the conveyance direction of the recording medium 2 can be prevented from varying and therefore the recording quality can be less affected thereby.

As illustrated in FIG. 7N, the cross-sectional area of the flow path may be different between the common supply flow path 211 and the common collection flow path 212. In the case where the cross-sectional areas of the flow paths are changed to be different, it is especially desirable to make the cross-sectional area of the common collection flow path 212 smaller than the cross-sectional area of the common supply flow path 211. By making the cross-sectional area of the common collection flow path 212 smaller than the cross-sectional area of the common supply flow path 211, the heat transferred from the liquid flowing in the common collection flow path 212 reduces around the common collection flow path 212 in the second flow path member 60. This arrangement enables reduction in the temperature gradient occurring in the second flow path member 60 further than in a case when the cross-sectional area of the common collection flow path 212 is approximately similar to the cross-sectional area of the common supply flow path 211. Thus, the warp of the second flow path member 60 is further controlled. Here, the cross-sectional area of the flow path refers to the average value of cross-sectional areas at randomly selected 10 locations.

Second Exemplary Embodiment

A second exemplary embodiment will be described with reference to FIGS. 9A to 9E. In the second exemplary embodiment, the same reference numerals are assigned to portions similar to the first exemplary embodiment, and omitting the descriptions thereof. FIGS. 9A to 9E are schematic views illustrating the configuration of the second flow path member 60 according to the present exemplary embodiment.

As described in the first exemplary embodiment, when the common supply flow path 211 and the common collection flow path 212 are arranged in the discharge direction of the liquid in such a manner that the common supply flow path 211 and the common collection flow path 212 overlap each other, a temperature gradient occurs in the discharge direction of the liquid. Therefore, the second flow path member 60 may be warped in the discharge direction of the liquid. Thus, it is further desirable that the common supply flow path 211 and the common collection flow path 212 are arranged in such a manner that the common collection flow path 212, the common supply flow path 211, and the element substrates 10 are placed in this order in the discharge direction of the liquid as illustrated in FIGS. 9A to 9E. The element substrates 10 include the heating elements as described above, and thus the temperature of the respective element substrates 10 also increases due to the driving of the heating elements. Therefore, the temperature of the respective element substrates 10 exceeds the temperature of the second flow path member 60 around the common supply flow path 212. This means that, among the common supply flow path 211, the common collection flow path 212, and the element substrate 10, the two of them with higher temperature are disposed on one end side and the other end side of the second flow path member 60 in the discharge direction of the liquid. Such a configuration enables reduction in the temperature gradient in the second flow path member 60 in the discharge direction of the liquid. In other words, the temperature gradient occurring in the discharge direction of the liquid reduces as compared to a case where the element substrates 10 and the common supply flow path 211 are disposed on one end side and the other end side, respectively. This enables the control of the warp of the second flow path member 60 in the discharge direction of the liquid. Such configurations as illustrated in FIGS. 9A to 9E enable also the control of the warp of the second flow path member 60 in the discharge direction of the liquid while controlling the deformation of the second flow path member 60 in the conveyance direction of the recording medium 2.

The positions of the common supply flow path 211 and the common collection flow path 212 are determined based on the position of the center of gravity of the cross section of the flow path. More specifically, disposing the common collection flow path 212 on the other end side of the above-described second flow path member 60 refers to the following layout. The layout intended thereby is that the common collection flow path 212 is disposed at such a position that the average value of the positions in the liquid discharge direction at which the centers of gravity of the cross sections of the common collection flow path 212 are located is closer to the other end side than the average value of the positions in the liquid discharge direction at which the centers of gravity of the cross sections of the common supply flow path 211 are located. The average value of the positions in the liquid discharge direction at which the centers of gravity of the cross sections of the common collection flow path 212 are located refers to a value obtained by determining each of the positions in the liquid discharge direction at which the centers of gravity of cross sections at randomly selected 10 locations of the common collection flow path 212 are located and calculating the average value of them. Similarly, the average value of the positions in the liquid discharge direction at which the centers of gravity of the cross sections of the common supply flow path 211 are located refers to a value obtained by determining each of the positions in the liquid discharge direction at which the centers of gravity of cross sections at randomly selected 10 locations of the common supply flow path 211 are located and calculating the average value of them.

Next, a method of forming the second flow path member 60 according to the above-described first exemplary embodiment and second exemplary embodiment will be described. FIGS. 10A to 10G are cross-sectional views of the second flow path member 60, and illustrate the common supply flow path 211, the individual supply flow path 213*a*, the common collection flow path 212, and the individual collection flow path 213*b*. The illustration in FIGS. 10A to 10G are simplified for the description.

Figure 10A:
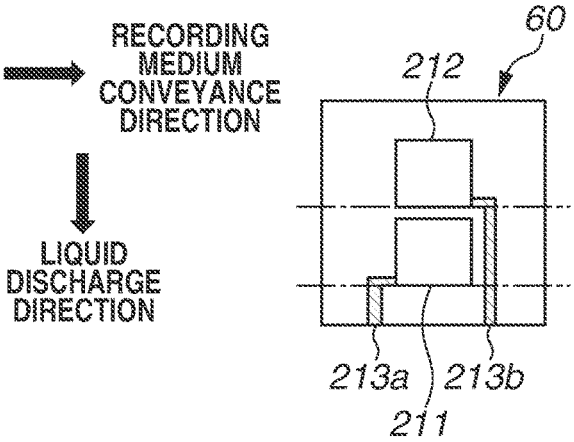
FIGS. 10A to 10G are cross-sectional views of the flow path member.
Figure 10B:
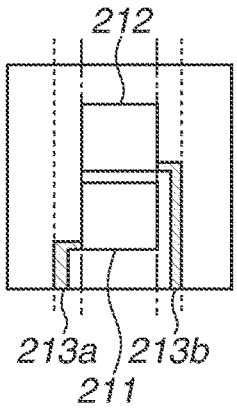
Figure 10C:
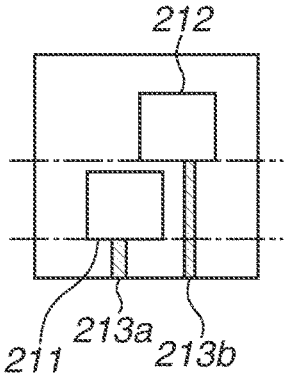
Figure 10D:
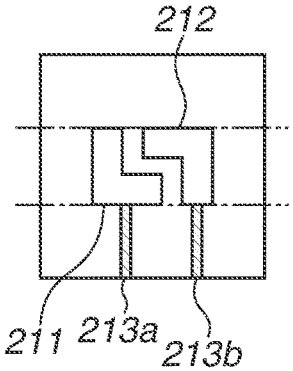
Figure 10E:
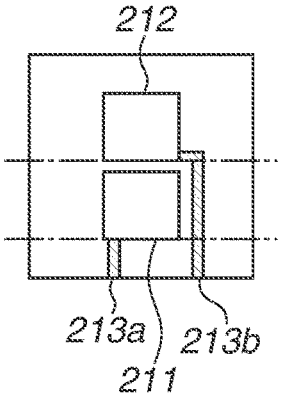
Figure 10F:
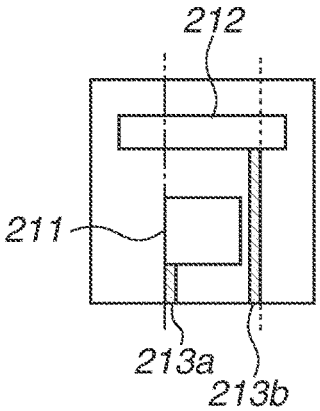
Figure 10G:
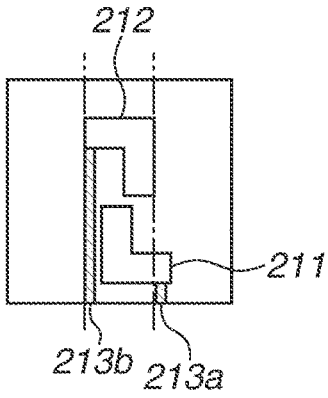

The second flow path member 60 is formed by joining a plurality of members using an adhesive, sintering, or the like. Dash-dotted lines in FIGS. 10A to 10G indicate minimum required division portions of members, and the second flow path member 60 is formed by stacking the divided members using an adhesive, sintering, or the like. The common supply flow path 211 and the common collection flow path 212 overlap in the liquid discharge direction, so that the individual supply flow path 213*a* and the individual collection flow path 213*b* are formed to bend as illustrated in FIG. 10A. The individual supply flow path 213*a* may be formed straight as illustrated in FIG. 10E instead of being formed as a bent flow path as illustrated in FIG. 10A. The second flow path member 60 may be formed by either a method in which the plurality of members are stacked in the liquid discharge direction as illustrated in FIG. 10A or a method in which the plurality of members are stacked in the conveyance direction of the recording medium 2 as illustrated in FIG. 10B.

According to the present disclosure, it is possible to provide the liquid discharge head capable of controlling deformation of the flow path member in the conveyance direction of the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-156221, filed Sep. 17, 2020, which is hereby incorporated by reference herein in its entirety.

What is claimed is:

1. A liquid discharge head comprising:

an element substrate including a plurality of discharge ports configured to discharge liquid in a discharge direction onto a recording medium, and a heating element configured to heat the liquid; and a flow path member including a supply flow path configured to supply the liquid to the element substrate and a collection flow path configured to collect the liquid from the element substrate, wherein the supply flow path and the collection flow path extend in a longitudinal direction of the flow path member and at least a part of the supply flow path and at least a part of the collection flow path overlap each other when viewed in a direction parallel to the discharge direction from one side to which the discharge ports are opened, wherein a cross-sectional area of the collection flow path is smaller than a cross-sectional area of the supply flow path.

2. The liquid discharge head according to claim 1, wherein a center of gravity of a cross section of the supply flow path and a center of gravity of a cross section of the collection flow path coincide with each other when viewed in the direction parallel to the discharge direction.

3. The liquid discharge head according to claim 1, wherein the supply flow path and the collection flow path entirely overlap each other when viewed in the direction parallel to the discharge direction.

4. The liquid discharge head according to claim 1, wherein the element substrate, the supply flow path, and the collection flow path are arranged in this order when viewed in the direction parallel to the discharge direction.

5. The liquid discharge head according to claim 1, further comprising a plurality of individual supply flow paths configured to supply the liquid to the element substrate and a plurality of individual collection flow paths configured to collect the liquid from the element substrate, wherein the supply flow path is a common supply flow path connected to the plurality of individual supply flow paths, and wherein the collection flow path is a common collection flow path connected to the plurality of individual collection flow paths.

6. The liquid discharge head according to claim 5, wherein the individual supply flow paths and the individual collection flow paths are formed in a first flow path member, wherein the common supply flow path and the common collection flow path are formed in a second flow path member, and wherein the flow path member includes the first flow path member and the second flow path member that are stacked.

7. The liquid discharge head according to claim 1, wherein the heating element is a pressure generation element configured to generate a pressure for discharging the liquid from the discharge ports by heating the liquid.

8. The liquid discharge head according to claim 1, wherein the heating element is a sub heater that is configured to heat the liquid and is different from a pressure generation element configured to generate a pressure for discharging the liquid from the discharge ports by heating the liquid.

9. The liquid discharge head according to claim 1, wherein the heating element includes a pressure generation element configured to generate a pressure for discharging the liquid from the discharge ports by heating the liquid, and a sub heater that is configured to heat the liquid and is different from the pressure generation element.

10. The liquid discharge head according to claim 1, wherein the liquid discharge head is a page wide-type liquid discharge head in which the plurality of discharge ports is arrayed from a portion corresponding to one end of the recording medium to a portion corresponding to the other end of the recording medium in a direction intersecting a conveyance direction of the recording medium.

* * * * *